US011097567B2

(12) United States Patent
Kambara et al.

(10) Patent No.: US 11,097,567 B2
(45) Date of Patent: Aug. 24, 2021

(54) BOOKBINDING APPARATUS

(71) Applicant: Horizon International Inc., Takashima (JP)

(72) Inventors: Kanta Kambara, Takashima (JP); Shigenobu Fukuda, Takashima (JP); Shigeru Wakimoto, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 16/943,199

(22) Filed: Jul. 30, 2020

(65) Prior Publication Data

US 2021/0039416 A1 Feb. 11, 2021

(30) Foreign Application Priority Data

Aug. 8, 2019 (JP) ..... JP2019-146004

(51) Int. Cl.

| | |
|---|---|
| ***B42C 1/12*** | (2006.01) |
| ***B65H 31/34*** | (2006.01) |
| ***B65H 37/04*** | (2006.01) |
| ***B42C 19/08*** | (2006.01) |
| ***B42C 19/00*** | (2006.01) |

(52) U.S. Cl.

CPC ..... *B42C 1/12* (2013.01); *B65H 31/34* (2013.01); *B65H 37/04* (2013.01); *B65H 2301/421* (2013.01); *B65H 2301/4382* (2013.01); *B65H 2301/44* (2013.01)

(58) Field of Classification Search

CPC ..... B42C 1/12; B65H 31/34; B65H 37/04; B65H 2301/44; B65H 2301/421; B65H 2301/4382

USPC ..... 412/9, 18, 19, 20, 22, 25, 29, 33

See application file for complete search history.

(56) References Cited

U.S. PATENT DOCUMENTS

| | | | |
|---|---|---|---|
| 6,019,560 | A | 2/2000 | Uchida et al. |
| 6,099,224 | A | 8/2000 | Uchida et al. |

(Continued)

FOREIGN PATENT DOCUMENTS

| | | | | |
|---|---|---|---|---|
| EP | 0790139 | A1 | 8/1997 | |
| JP | 3165954 | B2 | 5/2001 | |
| WO | WO-2018025464 | A1 * | 2/2018 | ..... B42C 9/00 |

OTHER PUBLICATIONS

Extended (Supplementary) European Search Report dated Dec. 11, 2020, issued in counterpart EP Application No. 20189801.2. (6 pages).

*Primary Examiner* — Justin V Lewis
(74) *Attorney, Agent, or Firm* — Westerman, Hattori, Daniels & Adrian, LLP

(57) ABSTRACT

A paper stack S supplied between clamping plates 1*a*, 1*b* of a carriage clamp 1 is pushed toward a positioning bar 2*b* by an alignment bar 5. A nip head 7 of a paper stack supplying unit 3 has first and second nip plates 9, 10, and a nip plate drive mechanism 11 moving each nip plate from a protruding position at which the nip plate protrudes from the nip head and a retracted position at which the nip plate retracts into the nip head, and translating the second nip plate taking the protruding position relative to the first nip plate taking the protruding position between a first position at which the first and second nip plates receive the paper stack therebetween and a second position at which the second nip plate cooperates with the first nip plate to grip the paper stack.

5 Claims, 8 Drawing Sheets

(56) References Cited

U.S. PATENT DOCUMENTS

| | | | | |
|---|---|---|---|---|
| 2009/0274536 | A1* | 11/2009 | Silberbauer | B42C 11/045 412/5 |
| 2015/0360382 | A1* | 12/2015 | Shiokawa | B26D 7/02 83/78 |
| 2019/0152249 | A1* | 5/2019 | Fukuda | B42C 9/0012 |

* cited by examiner

[Fig. 1A]
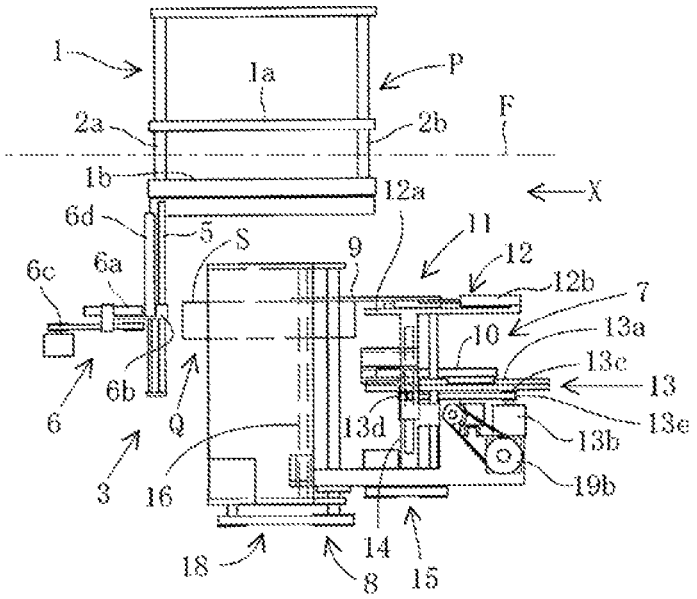
[Fig. 1B]
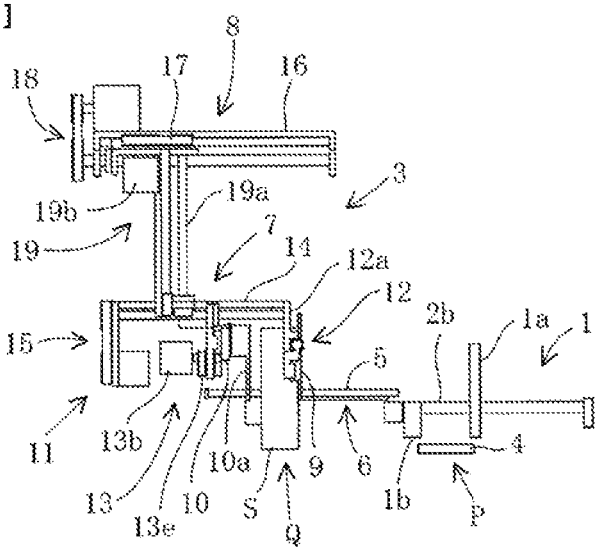

[Fig. 2]
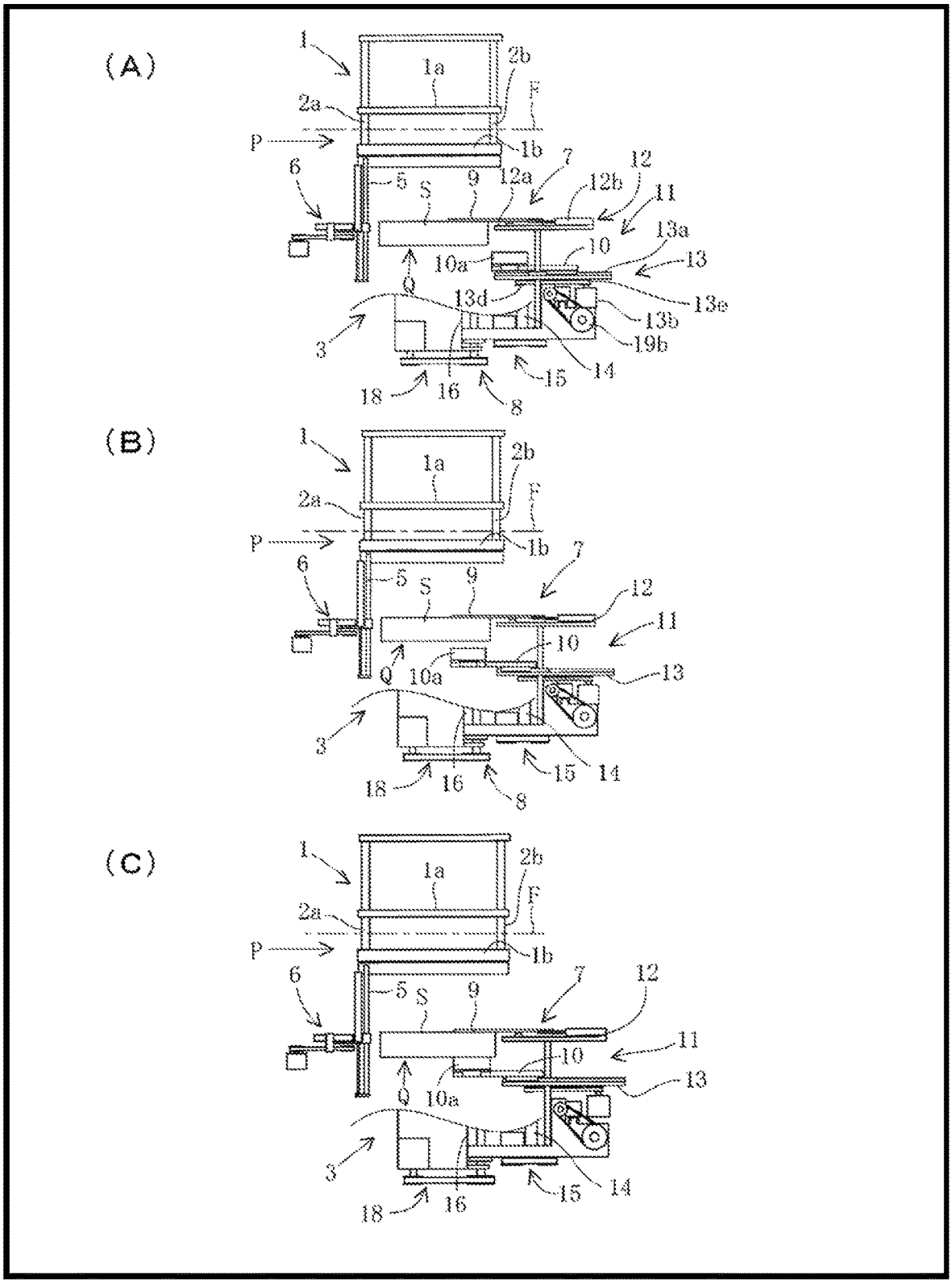

[Fig. 3]
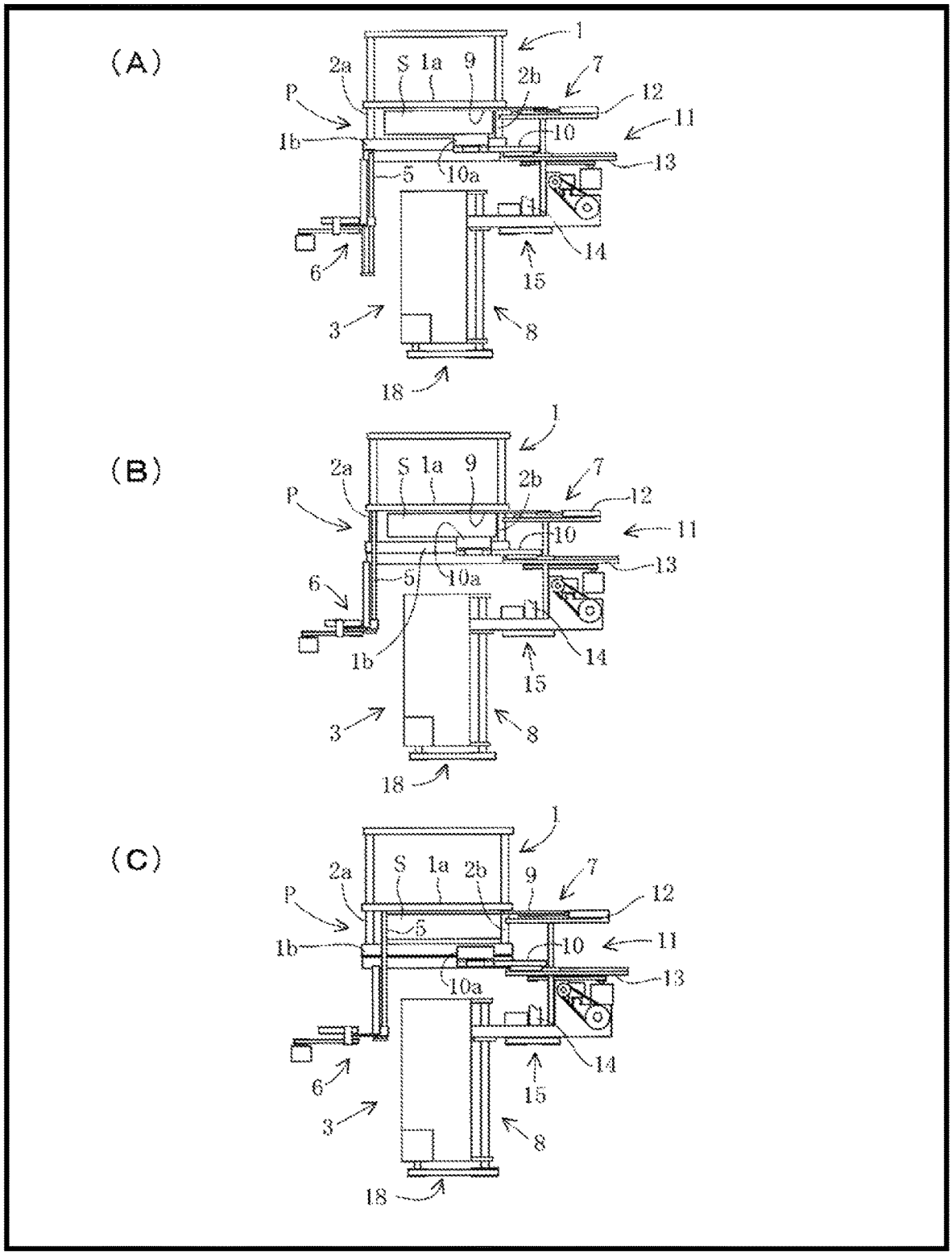

[Fig. 4]
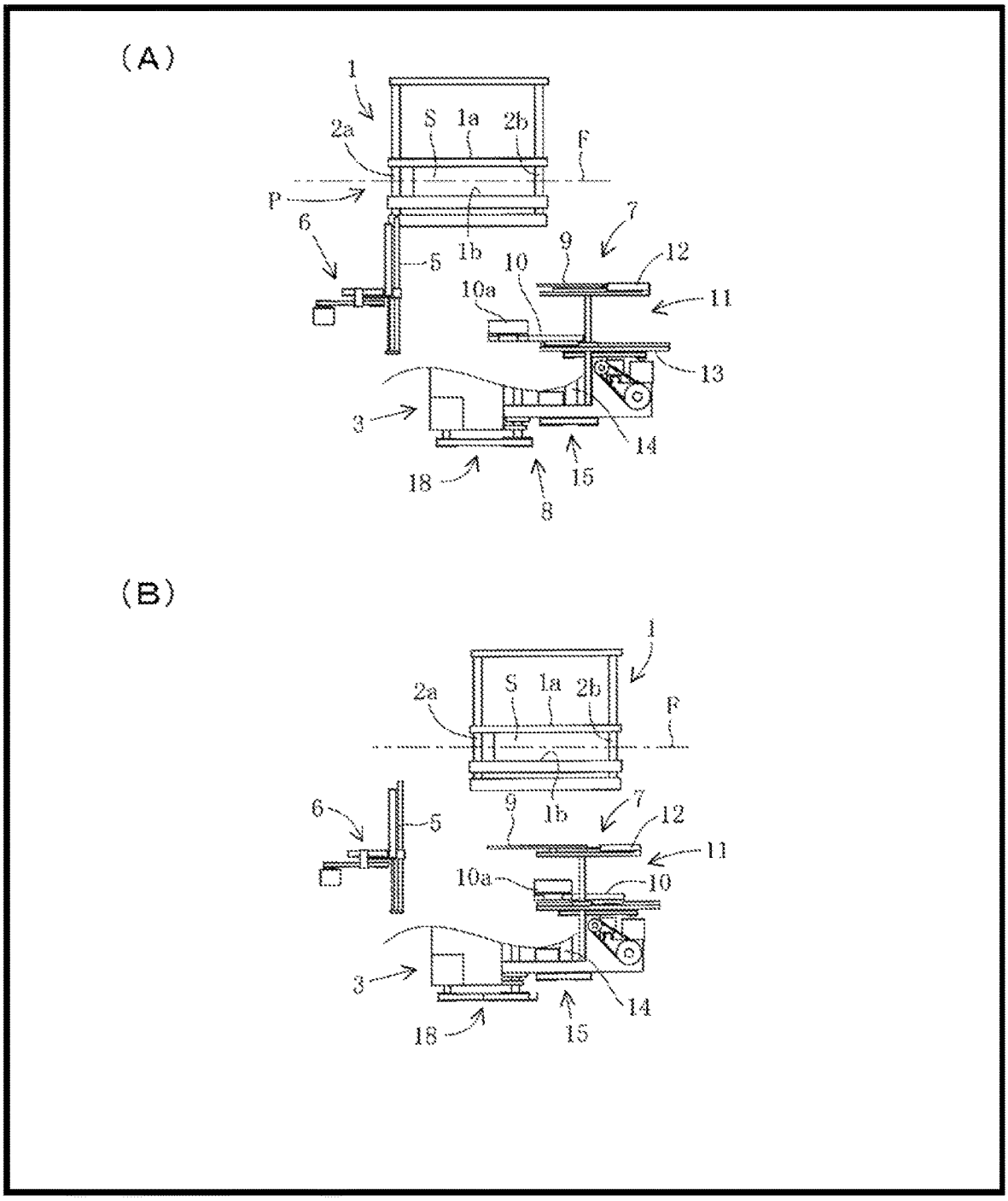

[Fig. 5]
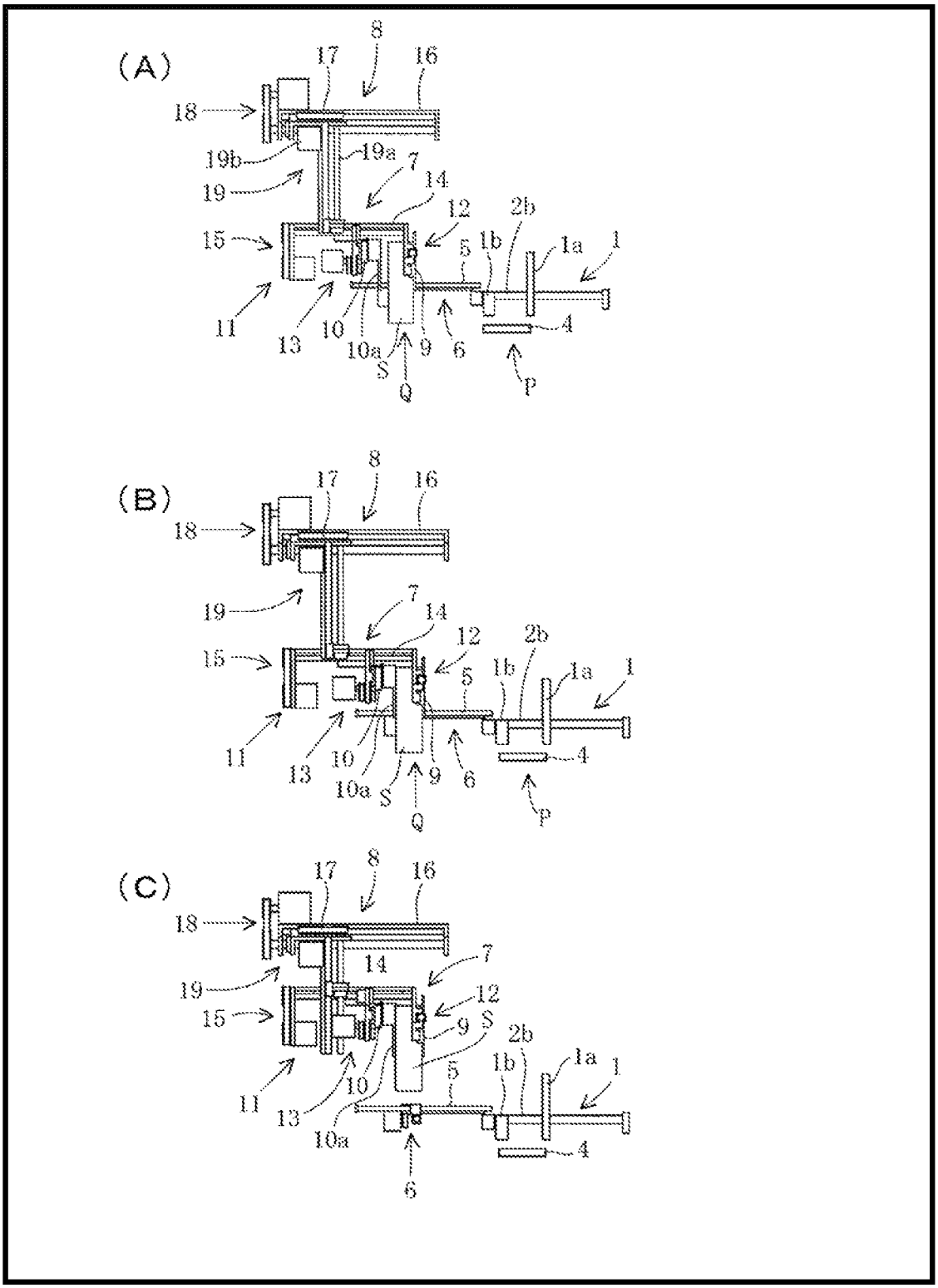

[Fig. 6]
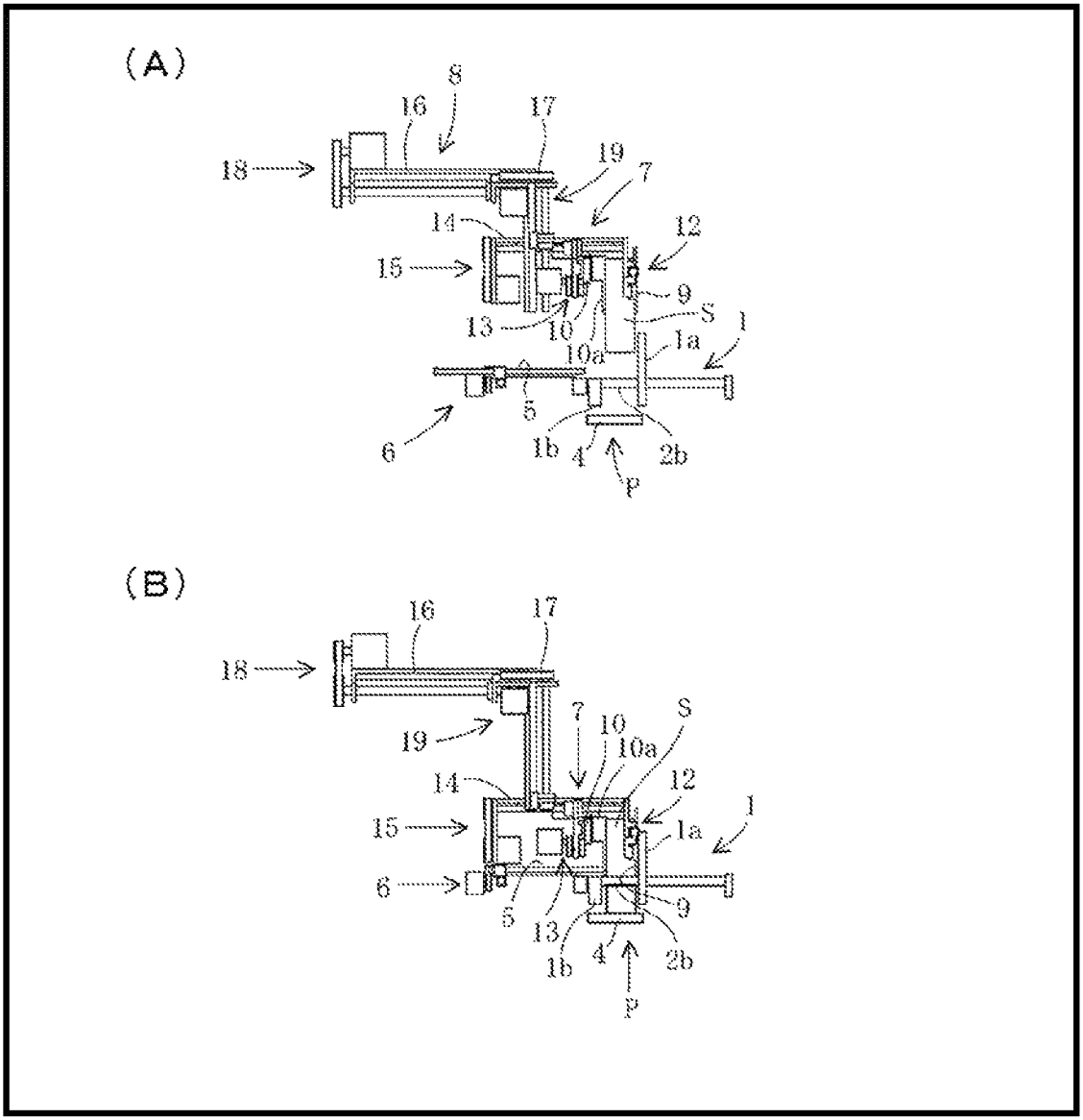

[Fig. 7]
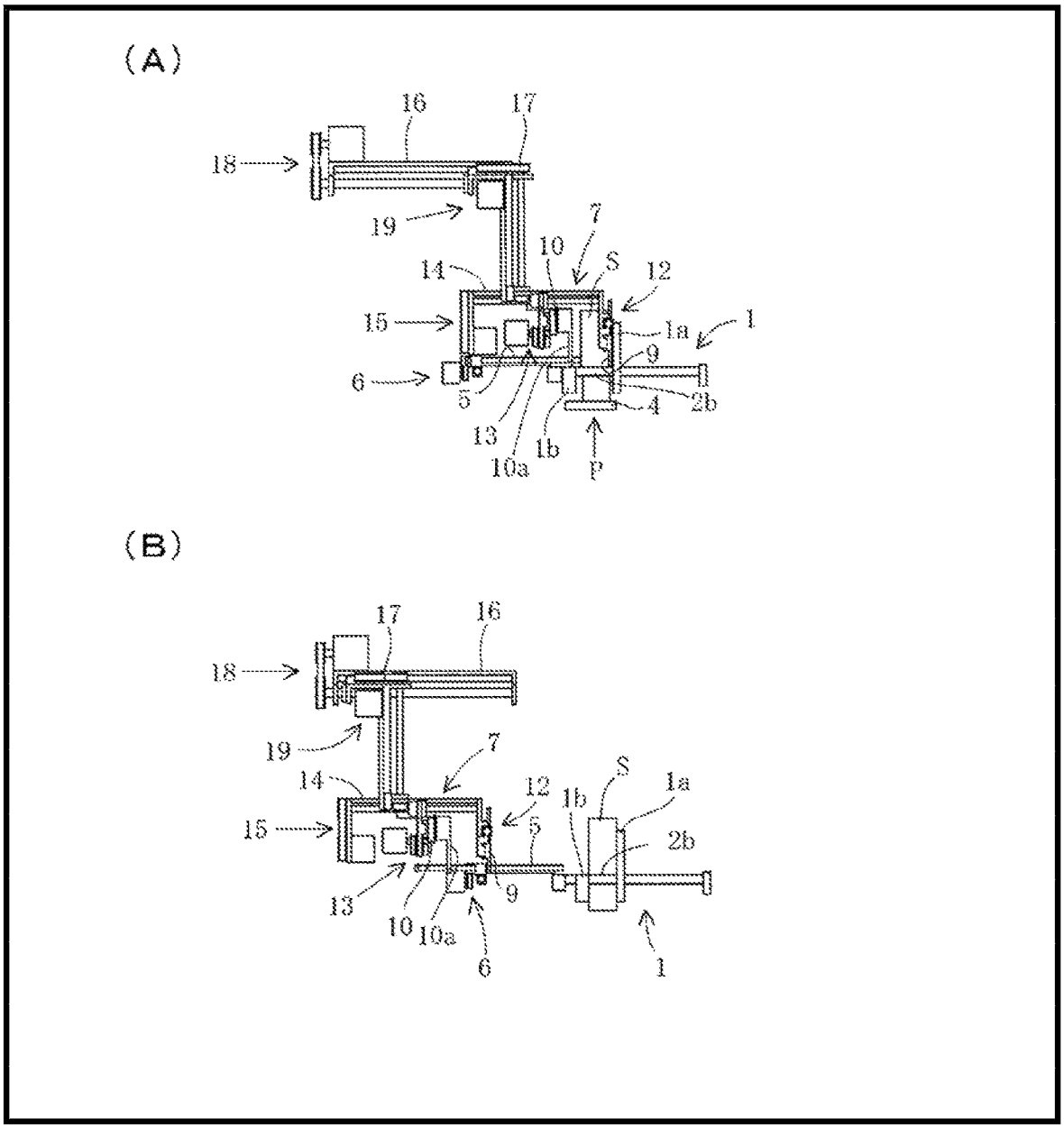

[Fig. 8A]
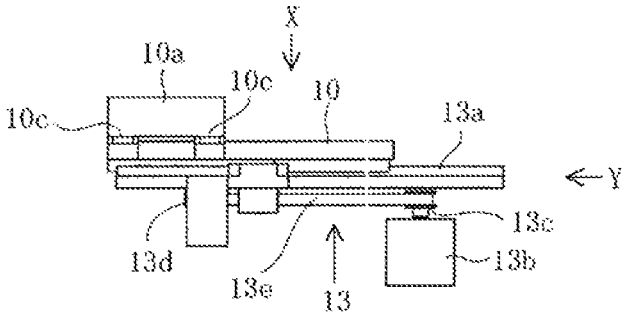
[Fig. 8B]
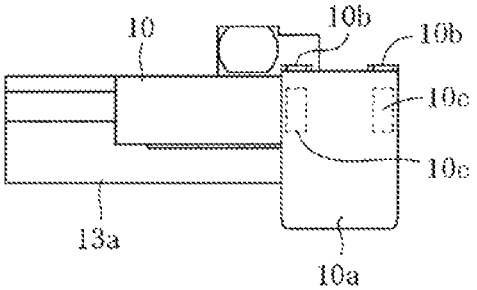
[Fig. 8C]
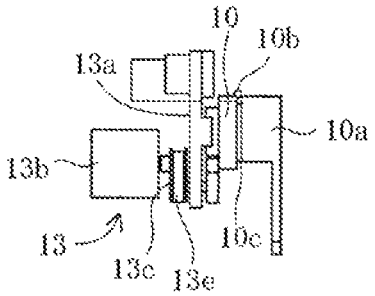
[Fig. 8D]
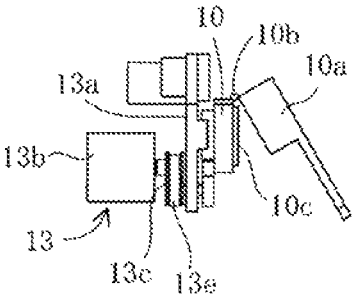

BOOKBINDING APPARATUS

TECHNICAL FIELD

The present invention relates to a bookbinding apparatus, particularly to a bookbinding apparatus comprising at least one carriage clamp movable along a predetermined path while gripping a paper stack, a series of processing units arranged along the path so as to perform bookbinding processing, and a paper stack supplying unit arranged at a paper stack supply position upstream of the series of processing units on the path so as to supply the paper stack to the at least one carriage clamp.

BACKGROUND ART

As a conventional paper stack supplying machine for bookbinding apparatus, there is, for example, a paper stack supplying machine for bookbinding apparatus disclosed in JP 3165954 B.

The paper stack supplying machine for bookbinding apparatus disclosed in JP 3165954 B is arranged between a printer or a copier and a bookbinding apparatus.

The bookbinding apparatus comprises at least one carriage clamp movable along a predetermined path and a series of processing units (a milling unit, a glue application unit and a cover attachment unit) arranged along the path so as to carry out bookbinding processing.

Then the paper stack supplying machine is arranged upstream of the series of processing units on the path.

The carriage clamp has a pair of clamping plates movable between an open position at which the pair of clamping plates receives the paper stack and a closed position at which the pair of clamping plates clamps both sides of the paper stack.

In the paper stack supply position, the paper stack is supplied between the pair of clamping plates taking the open position by the paper stack supplying machine, and then the pair of clamping plates takes the closed position, thereafter the paper stack is bound while the carriage clamp leaves the paper stack supplying position and sequentially passes through the series of processing units.

The paper stack supplying machine includes a paper stacking section stacking sheets discharged from the printer or copier one above the other to form the paper stack, a transport section horizontally transporting the paper stack received from the paper stacking section, and a swivel section swiveling the paper stack received from the transport section by 90 degrees and supplying the paper stack in a standing state to the carriage clamp stopping at the paper stack supply position.

The transport section has a pair of rollers arranged at intervals in the transport direction, an endless belt extended between the pair of rollers, a drive mechanism rotating the pair of rollers, and a pusher projected on the endless belt.

The pusher moves in the transport direction along with the rotational movement of the endless belt, thereby the paper stack is horizontally transported from the paper stacking section to the swivel section.

The swivel section has a pair of grip plates movable between an open position at which the pair of grip plates receives the paper stack and a closed position at which the pair of grip plates grips the paper stack, a stand moving up and down, an L-shaped arm attached to the stand at one end thereof so that the arm can rotate around a horizontal axis perpendicular to the transport direction of the transport section, the pair of grip plates being attached to the other end of the arm, and a drive mechanism rotating the arm forward and backward.

When the stand is in a raised position thereof, the arm can be rotated between a horizontal position at which the pair of grip plates extends in the transport direction at an exit of the transport section and a vertical position at which the pair of grip plates extends parallel to the pair of clamping plates above the carriage clamp stopping at the paper stack supply position.

The swivel section also has a vertical stopper arranged opposite the exit of the transport section with respect to the pair of grip plates when the arm takes the horizontal position and the pair of grip plates takes the open position.

When the arm takes the horizontal position and the pair of grip plates takes the open position, the paper stack is fed between the pair of grip plates from the transport section until a spine of the paper stack contacts with the stopper, and then the pair of grip plates takes the closed position.

Accordingly the paper stack is gripped by the pair of grip plates in a state wherein each paper sheet of the paper stack is aligned.

After that, the arm rotates from the horizontal position to the vertical position, so that the pair of grip plates gripping the paper stack is located right above a gap of the pair of clamping plates of the carriage clamp stopping at the paper stack supply position.

Next, after the stand lowers until a lower surface (spine) of the paper stack contacts with a level plate in the paper stack supply position and the pair of grip plates takes the open position, the stand starts to raise so that the pair of grip plates is pulled out from between the pair of clamping plates.

Then the pair of clamping plates takes the closed position and the paper stack supply to the carriage clamp by the paper stack supplying machine is completed.

Thereafter, while the carriage clamp leaves the paper stack supply position and sequentially passes through the series of processing units, the paper stack is bound.

However, according to this configuration, when the paper stack is inserted between the pair of clamping plates by the paper stack supplying machine and the pair of grip plates of the paper stack supplying machine is pulled upward from the pair of clamping plates, paper sheets forming the paper stack may follow the grip plates and shift upward due to the electrostatic force and/or frictional force generated between the paper sheets and the grip plates.

In this case, there is no way to align the misaligned paper stack again and therefore, the paper stack is nipped by the carriage clamp in a misaligned state and bound. Consequently, the finish of bookbinding becomes poor, or defective products occur.

SUMMARY OF THE INVENTION

Problems to be Solved by the Invention

It is, therefore, an object of the present invention to provide a bookbinding apparatus having a paper stack supplying unit capable of supplying a paper stack to a carriage clamp in a state where the paper stack is always aligned.

Means for Solving the Problems

In order to achieve this object, the present invention provides a bookbinding apparatus comprising: at least one carriage clamp movable along a predetermined path while gripping a paper stack in a standing state where a spine of the paper stack is directed downward, the at least one carriage clamp having a pair of clamping plates movable between an open position at which the pair of clamping plates receives the paper stack and a closed position at which the pair of clamping plates grips the paper stack, and a positioning bar extended across the pair of clamping plates at a right angle at one end of the carriage clamp movement direction, the paper stack supplied between the pair of clamping plates contacting with the positioning bar at a top or bottom thereof; a plurality of processing units arranged along the path so as to perform binding processing, a paper stack supply position being arranged upstream of a most upstream processing unit on the path, a paper stack receiving position being arranged on one side of the paper supply position with respect to the path; a paper stack supplying unit supplying the paper stack fed to the paper stack receiving position to the at lest one carriage clamp stopping at the paper stack supply position; and a horizontal plate arranged under the at least one carriage clamp stopping at the paper stack supply position so as to support a bottom of the paper stack supplied between the pair of clamping plates which takes the open position, characterized in that the paper stack is fed to the paper stack receiving position in an aligned and standing state where the spine of the paper stack is directed downward, wherein the paper stack supplying unit includes a nip head gripping the paper stack fed to the paper stack receiving position and supplying the paper stack between the pair of clamping plates stopping at the paper stack supply position, and a nip head drive mechanism moving the nip head between the paper stack receiving position and the paper stack supply position, the nip head having first and second nip plates extending parallel to the pair of clamping plates stopping at the paper stack supply position, and a nip plate drive mechanism moving each of the first and second nip plates in a longitudinal direction of the nip plate between a protruding position at which the nip plate protrudes from the nip head and a retracted position at which the nip plate retracts into the nip head, and translating the second nip plate taking the protruding position relative to the first nip plate taking the protruding position between a first position at which the second nip plate receives the paper stack between the first and second nip plates and a second position at which the second nip plate cooperates with the first nip plate to grip the paper stack, wherein when the nip head supplies the paper stack between the pair of clamping plates, the paper stack gripped by the nip head is placed on the horizontal plate between the pair of clamping plates, and the nip head is located opposite the pair of clamping plates with respect to the positioning bar of the carriage clamp.

According to a preferred embodiment of the present invention, the nip plate drive mechanism of the nip head includes a first nip plate actuating unit fixed to the nip head so as to support the first nip plate and move the first nip plate in a longitudinal direction of the first nip plate between the protruding position and the retracted position, a second nip plate actuating unit supporting the second nip plate and moving the second nip plate in a longitudinal direction of the second nip plate between the protruding position and the retracted position, a fist slide guide fixed to the nip head and extended at a right angle to the first and second nip plates between the first and second nip plate actuating units, the second nip plate actuating unit being slidably mounted on the first slide guide, the nip plate drive mechanism further including a drive mechanism attached to the nip head so as to slide the second nip plate actuating unit.

According to another preferred embodiment of the present invention, the paper stack fed to the paper stack receiving position is located right beside the pair of clamping plates of the at least one carriage clamp stopping at the paper stack supply position, wherein the nip head drive mechanism of the paper stack supplying unit includes a second slide guide extending in a direction perpendicular to the pair of clamping plates stopping at the paper stack supply position above the paper stack receiving position, a slider slidably mounted on the second slide guide, a slider drive mechanism sliding the slider, and an elevating mechanism attached to the slider so as to support the nip head in a manner such that the nip head can move up and down.

According to further preferred embodiment of the present invention, the bookbinding apparatus further comprises an alignment bar arranged above or below the pair of clamping plates of the at least one carriage clamp stopping the paper stack supply position, extended parallel to the positioning bar of the at least one carriage clamp and across the pair of clamping plates and movable horizontally in a direction toward and away from the positioning bar, wherein, after the paper stack is supplied between the pair of clamping plates taking the open position, the alignment bar pushes an end face of the paper stack far from the positioning bar toward the positioning bar.

Effect of the Invention

According to the present invention, in the bookbinding apparatus in which the carriage clamp has a positioning bar and the paper stack supplied between the pair of clamping plates of the carriage clamp contacts with the positioning bar at the top or bottom thereof, the nip head has the first and second nip plates extending parallel to the pair of clamping plates stopping at the paper stack supply position, and the nip plate drive mechanism moving each of the first and second nip plates in the longitudinal direction of the nip plate between the protruding position at which the nip plate protrudes from the nip head and the retracted position at which the nip plate retracts into the nip head, and translating the second nip plate taking the protruding position relative to the first nip plate taking the protruding position between the first position at which the second, nip plate receives the paper stack between the first and second nip plates and the second position at which the second nip plate cooperates with the first nip plate to grip the paper stack.

Furthermore, when the nip head supplies the paper stack between the pair of clamping plates, the paper stack gripped by the nip head is placed on the horizontal plate between the pair of clamping plates, and the nip head is located opposite the pair of clamping plates with respect to the positioning bar of the carriage clamp.

Thus the supply of the paper stack is carried out by moving the second nip plate from the second position to the first position (releasing the grip of the paper stack) and then moving the first nip plate from the protruding position to the retracted position, or moving the second nip plate from the second position to the first position (releasing the grip of the paper stack) and then moving the first and second nip plates from the protruding position to the retracted position.

That is to say, after releasing the grip of the paper stack by the first and second nip plates of the nip head, only the first nip plate of both of the first and second nip plates are retracted in a direction in which the paper stack abuts the positioning bar.

Therefore, paper sheets forming the paper stack supplied between the pair of clamping plates do not follow the retracting movement, of the first and second nip plates at all, whereby the misalignment of the paper stack does not occur.

Thus the paper stack is supplied to the carriage clamp in a state where the paper stack is always aligned, and accordingly defective bookbinding is reliably prevented.

BRIEF DESCRIPTION OF THE DRAWINGS

FIG. 1A is a plan view showing a configuration near a paper stack supplying unit of a bookbinding apparatus according to an embodiment of the present invention.

FIG. 1B is a side view seen in a direction of an arrow X in FIG. 1A.

FIG. 2 is a view similar to FIG. 1A for explaining the operation of supplying a paper stack to a carriage clamp of the bookbinding apparatus shown in FIGS. 1A and 1B.

FIG. 3 is a view similar to FIG. 1A for explaining the operation of supplying a paper stack to a carriage clamp of the bookbinding apparatus shown in FIGS. 1A and 1B.

FIG. 4 is a view similar to FIG. 1A for explaining the operation of supplying a paper stack to a carriage clamp of the bookbinding apparatus shown in FIGS. 1A and 1B.

FIG. 5 is a view similar to FIG. 1B for explaining the operation of supplying a paper stack to a carriage clamp of the bookbinding apparatus shown in FIGS. 1A and 1B.

FIG. 6 is a view similar to FIG. 1B for explaining the operation of supplying a paper stack to a carriage clamp of the bookbinding apparatus shown in FIGS. 1A and 1B.

FIG. 7 is a view similar to FIG. 1B for explaining the operation of supplying a paper stack to a carriage clamp of the bookbinding apparatus shown in FIGS. 1A and 1B.

FIG. 8A is a enlarged plan view of a second nip plate and a second nip plate actuating unit of the paper supplying unit of the bookbinding apparatus shown in FIGS. 1A and 1B, in which a flap of a second nip plate is located at a normal position.

FIG. 8B is a side view seen in a direction of an arrow X in FIG. 8A.

FIG. 8C is a side view seen in a direction of an arrow Y in FIG. 8A.

FIG. 8D is a view similar to FIG. 8C illustrating the flap rotated from the normal position.

BEST MODE FOR CARRYING OUT THE INVENTION

A preferred embodiment of the present invention will be explained below with reference to accompanying drawings.

FIG. 1A is a plan view showing a configuration near a paper stack supplying unit of a bookbinding apparatus according to an embodiment of the present invention, and FIG. 1B is a side view seen in a direction of an arrow X in FIG. 1A.

FIGS. 2 to 4 are views similar to FIG. 1A for explaining the operation of supplying a paper stack to a carriage clamp of the bookbinding apparatus shown in FIGS. 1A and 1B, and FIGS. 5 to 7 are views similar to FIG. 1B for explaining the operation of supplying a paper stack to a carriage clamp of the bookbinding apparatus shown in FIGS. 1A and 1B.

Referring to FIGS. 1A to 7, a bookbinding apparatus according to the present invention comprises at least one carriage clamp 1 movable along a predetermined path F while gripping a paper stack S in a standing state where a spine of the paper stack is directed downward.

The carriage clamp 1 has a pair of clamping plates 1*a*, 1*b* movable between an open position at which the pair of clamping plates 1*a*, 1*b* receives the paper stack S and a closed position at which the pair of clamping plates 1*a*, 1*b* grips the paper stack S.

The pair of clamping plates 1*a*, 1*b* consists of a vertical fixed clamping plate 1*a* and vertical movable clamping plate 1*b*.

A pair of actuating rods 2*a*, 2*b* extends perpendicularly to and through the fixed clamping plate 1*a* at both ends of the fixed clamping plate 1*a* in a moving direction of the carriage clamp 1, and the movable clamping plate 1*b* is fixed to leading ends of the actuating rods 2*a*, 2*b*.

The actuating rods 2*a*, 2*b* are moved in longitudinal directions thereof by a clamping plate drive mechanism (not shown) so that the movable clamping plate 1*b* moves close to and away from the fixed clamping plate 1*a*, thereby the carriage clamp 1 is moved between the open and closed positions.

As can be seen in FIG. 1B and FIGS. 5 to 7, the fixed clamping plate 1*a* extends upward from the actuating rods 2*a*, 2*b*, while an upper edge of the movable clamping plate 1*b* is almost at the same height as the actuating rods 2*a*, 2*b*.

A gap between the pair of actuating rods 2*a*, 2*b* is set to be larger than a vertical length (a length from top to bottom) of the paper stack S, and one actuating rod 2*b* of the pair of actuating rods 2*a*, 2*b* also functions as a positioning bar with which the paper stack S supplied between the pair of clamping plates 1*a*, 1*b* contacts at the top or bottom thereof.

Furthermore, the bookbinding apparatus comprises a plurality of processing units (although not shown, a milling unit, a glue application unit, a cover attachment unit and so on).

A paper stack supply position P is arranged upstream of a most upstream processing unit on the path F, and a paper stack receiving position Q is arranged on one side of the paper stack supply position P with respect to the path F (in this embodiment, outside the movable clamping plate 1*b* of the carriage clamp 1 stopping at the paper stack supply position P).

In this embodiment, the paper stack receiving position Q is located right beside the pair of clamping plates 1*a*, 1*b* stopping at the paper stack supply position P, and the paper stack S is fed to the paper stack receiving position Q in a standing and aligned state where a spine of the paper stack S is directed downward.

The bookbinding apparatus further comprises a paper stack supplying unit 3 supplying the paper stack S fed to the paper stack receiving position Q to the carriage clamp 1 stopping at the paper stack supply position P.

A horizontal plate 4 is arranged under the carriage clamp 1 stopping at the paper stack supply position P so as to support the bottom of the paper stack S supplied between the pair of clamping plates 1*a*, 1*b* which takes the open position.

Outside the movable clamping plate 1*b* of the carriage clamp 1 stopping at the paper stack supply position P and on the side of the other actuating rod 2*a* of the carriage clamp 1, an alignment bar 5 extended parallel to the actuating rods 2*a*, 2*b* and movable in a longitudinal direction thereof and in a direction perpendicular to the longitudinal direction, and an alignment bar drive mechanism 6 are arranged.

The alignment bar drive mechanism 6 includes a horizontal slide guide 6*a* extending at a right angle to the actuating rods 2*a*, 2*b*, a slider 6*b* slidably mounted on the slide guide 6*a*, a slider drive mechanism 6*c* attached to the slide guide 6*a* so as to slide the slider 6*b*, and a linear actuator (cylinder) 6*d* attached to the slider 6*b* and extended parallel to the actuating rods 2*a*, 2*b*.

The alignment bar 5 is guided by a guide (not shown) attached to the slider 6*b* in a manner to move in a longitudinal direction thereof, and fixed to an actuating rod (not shown) of the linear actuator 6*d* at a rear end thereof.

The alignment bar 5 can be moved by the linear actuator fid in the longitudinal direction thereof between a retracted position at which the alignment bar 5 retracts from a migration path of the carriage clamp 1 and an advanced position at which the alignment bar 5 protrudes into a gap of the pair of clamping plates 1*a*, 1*b* taking the open position above the movable clamping plate 1*b* of the pair of clamping plates 1*a*, 1*b* so as to extend across the pair of clamping plates 1*a*, 1*b*.

As the slider 6*b* is slid by the slider drive mechanism 6*c*, the alignment, bar 5 taking the advanced position is moved horizontally between a standby position at which the alignment bar is located right above the actuating rod 2*a* and an aligning position at which the alignment bar 5 pushes an end face of the paper stack S supplied between the pair of clamping plates 1*a*, 1*b* far from the actuating rod (positioning bar) 2*b* against the actuating rod (positioning bar) 2*b*.

The paper stack supplying unit 3 includes a nip head 7 gripping the paper stack S fed to the paper stack receiving position Q and supplying the paper stack S between the pair of clamping plates 1*a*, 1*b* stopping at the paper stack supply position P, and a nip head drive mechanism 8 moving the nip head 7 between the paper stack receiving position Q and the paper stack supply position P.

The nip head 7 has first and second nip plates 9, 10 extending parallel to the pair of clamping plates 1*a*, 1*b* stopping at the paper stack supply position P, and a nip plate drive mechanism 11 moving each of the first and second nip plates 9, 10 in a longitudinal direction of the nip plate 9, 10 between a protruding position at which the nip plate 9, 10 protrudes from the nip head 7 and a retracted position at which the nip plate 9, 10 retracts into the nip head 7, and translating the second nip plate 10 (a nip plate far from the paper stack supplying position P) taking the protruding position relative to the first nip plate 9 (a nip plate closer to the paper stack supply position P) taking the protruding position between a first position at which the second nip plate 10 receives the paper stack S between the first and second nip plates 9, 10 and a second position at which the second nip plate 10 cooperates with the first nip plate 9 to grip the paper stack S.

In this embodiment, the nip plate drive mechanism 11 includes a first nip plate actuating unit 12 fixed to the nip head 7 so as to support the first nip plate 9 and move the first nip plate 9 in a longitudinal direction of the first nip plate 9 between the protruding position and the retracted position, a second nip plate actuating unit 13 supporting the second nip plate 10 and moving the second nip plate 10 in a longitudinal direction of the second nip plate 10 between the protruding position and the retracted position, and a slide guide 14 fixed to the nip head 7 and extended at a right angle to the first and second nip plates 9, 10 between the first and second nip plate actuating units 12, 13.

The second nip plate actuating unit 13 is slidably mounted on the slide guide 14.

The nip plate drive mechanism 11 further includes a drive mechanism 15 attached to the nip head 7 so as to slide the second nip plate actuating unit 13.

In this embodiment, the first nip plate actuating unit 12 has a horizontal slide guide 12*a* attached to the nip head 7 and extended in a longitudinal direction of the first nip plate 9, and the first nip plate 9 is slidably mounted on the slide guide 12*a*.

The first nip plate actuating unit 12 further has a linear actuator (cylinder) 12*b* attached to the nip head 7 and extended parallel to the slide guide 12*a*.

The first nip plate 9 is attached to an actuating rod of the linear actuator 12*b* at a base portion thereof so that the first nip plate 9 is moved between the protruding position and the retracted position by the linear actuator 12*b*.

The second nip plate actuating unit 13 has a slide guide 13*a* extended parallel to the slide guide 12*a* of the first nip plate actuating unit 12, and the second nip plate 10 is slidably mounted on the slide guide 12*a*.

The second nip plate actuating unit 13 further has a motor 13*b* arranged opposite the second nip plate 10 with respect to the slide guide 13*a*.

A drive shaft of the motor 13*b* extends horizontally and at a right angle to the moving direction of the second nip plate 10, and a pulley 13*c* is fixed to the drive shaft of the motor 13*b*.

The second nip plate actuating unit 13 further has a pulley 13*d* spaced from the drive shaft of the motor 13*b* along the length of the slide guide 12*a* and mounted on a rotary shaft parallel to the drive shaft, and an endless belt 13*e* extended between the pulley 13*c* and pulley 13*d*.

The second nip plate 10 is attached to the endless belt 13*e* at a base portion thereof, and the second nip plate 10 is moved between the protruding position and the retracted position as the endless belt 13*e* is rotated by the motor 13*b*.

Thus the first and second nip plates 9, 10 are moved between the protruding and retracted positions by the first and second nip plate actuating units 12, 13, respectively, and the second nip plate 10 taking the protruding position is moved between the first and second positions with the slide movement of the second nip plate actuating unit 13 by the drive mechanism 15.

FIG. 8A is a enlarged plan view of a second nip plate and a second nip plate actuating unit of the paper supplying unit of the bookbinding apparatus shown in FIGS. 1A and 1B, in which a flap of a second nip plate is located at a normal position.

FIG. 8B is a side view seen in a direction of an arrow X in FIG. 8A, and FIG. 8C is a side view seen in a direction of an arrow Y in FIG. 8A, and FIG. 8D is a view similar to FIG. 8C illustrating the flap rotated from the normal position.

As shown in FIGS. 8A-8D, in this embodiment, the second nip plate 10 is provided with a flap 10*a* made of ferromagnetic material at a head thereof.

In this case, the flap 10*a* is connected to an upper edge of the second nip plate 10 through a spring hinge 10*b* at one side thereof, while a magnet 10*c* is attached to an internal surface of the second nip plate 10 (a surface of the second nip plate 10 facing the first nip plate 9) so as to attract the flap 10*a*.

Thus the flap 10*a* is always folded on the inner surface of the second nip plate 10 by the biasing force of the spring hinge and the magnetic force of the magnet 10*c* (a normal position of the flap 10*a*).

In this normal position, a surface of the flap 10*a* facing the first nip plate 9 is extended parallel to the second nip plate 10 and the flap 10*a* protrudes downward from the lower end of the second nip plate 10.

On the other hand, while the second nip plate 10 moves from the second position to the first position or the nip head 7 moves from the paper stack receiving position Q to the paper stack supply position P, when the downwardly protruding portion of the flap 10*a* contacts an obstacle, the flap 10*a* is, as shown in FIG. 8D, rotated from the normal position so as to avoid collision with the obstacle, thereby damage of the second nip plate 10 is prevented.

Referring to FIGS. 1A to 7 again, in this embodiment, the nip head drive mechanism 8 includes a horizontal slide guide 16 extending in a direction perpendicular to the pair of clamping plates 1*a*, 1*b* stopping at the paper stack supply position P above the paper stack receiving position Q, a slider 17 slidably mounted on the slide guide 16, a slider drive mechanism 18 sliding the slider 17, and an elevating mechanism 19 attached to the slider 17 so as to support the nip head 7 in a manner such that the nip head 7 can move up and down.

The elevating mechanism 19 has a slide guide 19*a* extending vertically downward from the slider 17, and the nip head 7 is slidably mounted on the slide guide 19*a*.

The elevating machine 19 further has a drive mechanism 19*b* attached to the slider 17 so as to slide the nip head 7.

In this case, the nip head 7 is slidably mounted on the slide guide 19*a* in such a way that, in the paper stack supply position P, the nip head 7 is located opposite the pair of clamping plates 1*a*, 1*b* of the carriage clamp 1 stopping at the paper stack supply position P with respect to the actuating rod (positioning bar) 2*b* of the carriage clamp 1 and the first and second nip plates 3, 10 taking the protruding positions thereof extends to the pair of clamping plates 1*a*, 1*b* over the actuating rod (positioning bar) 2*b*.

Thus the nip head 7 is horizontally reciprocated between the paper stack receiving position Q and the paper stack supply position P as the slider 17 is slid by the slider drive mechanism 18, and moved up and down along the slide guide 19*a* by the drive mechanism 19*b*.

Next, the operation of supplying the paper stack to the carriage clamp of the bookbinding apparatus of the present invention will be described with reference to FIGS. 2 to 7.

As shown in FIGS. 2A and 5A, when the carriage clamp 1 stops at the paper stack supply position P and the pair of clamping plates 1*a*, 1*b* takes the open position on the one hand and the paper stack S is fed to the paper stack receiving position Q on the other hand, the nip head 7 arrives at the paper stack receiving position Q.

At this time, the first nip plate 9 of the nip head 7 is located at the protruding position and opposite to front or back side of the paper stack S, and the second nip plate 10 of the nip head 7 is located at the first position and retracted position.

Then, as shown in FIG. 2B, the second nip plate 10 moves from the retracted position to the protruding position, and as shown in FIGS. 2C and 5B, the second nip plate 10 moves from the first position to the second position so that the first and second nip plates 9, 10 grip the paper stack S.

Next, the nip head 7 moves up so that the paper stack S is lifted (see. FIG. 5C), where a bottom edge of the paper stack S is higher than a top edge of the movable clamping plate 1*b* of the carriage clamp 1 stopping at the paper stack supply position P.

Thereafter the nip head 7 moves to the paper stack supply position P (see, FIGS. 3A and 6A).

When the nip head 7 arrives at the paper stack supply position P, the paper stack S gripped by the nip head 7 is located right above the gap of the pair of clamping plates 1*a*, 1*b* and the nip head 7 is located opposite the pair of clamping plates 1*a*, 1*b* with respect to the actuating rod (positioning bar) 2*b* above the carriage clamp 1.

Next, the nip head 7 moves down so that the paper stack S gripped by the nip head 7 is inserted between the pair of clamping plates 1*a*, 1*b*. Then, as shown in FIG. 6B, when the bottom edge (spine) of the paper stack S gripped by the nip head 7 contacts the horizontal plate 4, the nip head 7 stops the downward movement.

At this time, the first nip plate 9 is located inside the fixed clamping plate 1*a*, while the second nip plate 10 is located above the movable clamping plate 1*b*.

The nip head 7 is located opposite the pair of clamping plates 1*a*, 1*b* with respect to the actuating rod (positioning bar) 2*b*.

During the downward movement of the nip head 7, as shown in FIG. 3B, the alignment bar 5 taking the standby position moves from the retracted position to the advanced position.

Furthermore, as shown in FIGS. 3C and 7A, after the second nip plate 10 moves from the second position to the first position (release of the grip of the paper stack S), the alignment bar 5 moves from the standby position to the alignment position and the first nip plate 9 moves from the protruding position to the retracted position, thereafter the alignment bar 5 returns from the alignment position to the standby position, thereby the paper stack S is supplied between the pair of clamping plates 1*a*, 1*b* in an aligned state.

Then the alignment bar 5 moves from the advanced position to the retracted position and the nip head 7 starts to move toward the paper stack receiving position Q.

Next, the pair of clamping plates 1*a*, 1*b* takes the closed position to grip the paper stack S, and accordingly the supply of the paper stack S to the pair of clamping plates 1*a*, 1*b* by the nip head 7 is completed (see, FIGS. 4A and 7B).

After that, during the movement of the nip head 7 toward the paper stack receiving position Q, the first nip plate 9 moves from the retracted position to the protruding position while the second nip plate 10 moves from the protruding position to the retracted position so that the nip head 7 may be ready to receive the next paper stack S.

On the one hand, the carriage clamp 1 gripping the paper stack S leaves the paper stack supply position F and moves toward each of the processing units along the path F (see, FIG. 4B).

According to the bookbinding apparatus of the present invention, after releasing the grip of the paper stack S by the first and second nip plates 9, 10 of the nip head 7, the first nip plate 9 is retracted in the same direction as the aligning direction in synchronization with the aligning motion of the alignment bar 5, whereby the paper stack S is supplied between the pair of clamping plates 1*a*, 1*b*.

Therefore, paper sheets forming the paper stack S inserted between the pair of clamping plates 1*a*, 1*b* do not follow the retracting movement of the first and second nip plates 9, 10 at all, whereby the misalignment of the paper stack S does not occur.

Thus the paper stack S is supplied to the carriage clamp 1 in a state where the paper stack S is always aligned, and accordingly defective bookbinding is reliably prevented.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present, invention.

For example, although in the above-mentioned embodiment, when the nip head 7 supplies the paper stack S to the carriage clamp 1, only the first nip plate 9 is retracted in the same direction as the aligning direction of the alignment bar 5 after releasing the grip of the Paper stack S by the first and second nip plates 9, 10, if necessary, both of the first and second nip plates 9, 10 may be retracted in the same direction as the aligning direction of the alignment bar 5 after releasing the grip of the paper stack S by the first and second nip plates 9, 10.

Although the bookbinding apparatus comprises the alignment bar 5 and the retracting movement of the first nip plate 9 of the nip head 7 is synchronized with the aligning motion of the alignment bar 5 in the above-mentioned embodiment, the bookbinding apparatus does not need to have the alignment bar when the paper stack S is supplied to the pair of clamping plates 1*a*, 1*b* by the nip head 7 in a manner such that the top or bottom of the paper stack S abuts the actuating rod (positioning bar) 2*b* of the carriage clamp 1.

In this case, the first nip plate 9 is retracted in a direction in which the paper stack S abuts the actuating rod (positioning bar) 2*b*, and therefore, sheet papers forming the sheet stack S supplied between the pair of clamping plates 1*a*, 1*b* do not shift by following the movement of the first and second nip plates 9, 10 at all.

DESCRIPTION OF REFERENCE NUMERALS

1 Carriage clamp
1*a* Fixed clamping plate
1*b* Movable clamping plate
2*a* Actuating rod
2*b* Actuating rod (positioning bar)
3 Paper stack supplying unit
4 Horizontal plate
5 Alignment bar
6 Alignment bar drive mechanism
6*a* Slide guide
6*b* Slider
6*c* Slider drive mechanism
6*d* Linear actuator
7 Nip head
8 Nip head drive mechanism
9 First nip plate
10 Second nip plate
10*a* Flap
10*b* Spring hinge
10*c* Magnet
11 Nip plate drive mechanism
12 First nip plate actuating unit
12*a* Slide guide
12*b* Linear actuator
13 Second nip plate actuating unit
13*a* Slide guide
13*b* Motor
13*c* Pulley
13*d* Pulley
13*e* Endless belt
14 Slide guide
15 Drive mechanism
16 Slide guide
17 Slider
18 Slider drive mechanism
19 Elevating mechanism
19*a* Slide guide
19*b* Drive mechanism
F Path
S Paper stack
P Paper stack supplying position
Q Paper stack receiving position

The invention claimed is:

1. A bookbinding apparatus comprising:

at least one carriage clamp movable along a predetermined path while gripping a paper stack in a standing state where a spine of the paper stack is directed downward, the carriage clamp having a pair of clamping plates movable between an open position at which the pair of clamping plates receives the paper stack and a closed position at which the pair of clamping plates grips the paper stack, and a positioning bar extended across the pair of clamping plates, the positioning bar being perpendicular to the predetermined path, the paper stack supplied between the pair of clamping plates contacting with the positioning bar at a top or bottom of the paper stack;

a plurality of processing units arranged along the path so as to perform binding processing, a paper stack supply position being arranged upstream of a most upstream processing unit among the plurality of processing units on the path, a paper stack receiving position being arranged on one side of the paper stack supply position with respect to the path;

a paper stack supplying unit supplying the paper stack fed to the paper stack receiving position to the at least one carriage clamp stopping at the paper stack supply position; and a horizontal plate arranged under the at least one carriage clamp stopping at the paper stack supply position so as to support a bottom of the paper stack supplied between the pair of clamping plates in the open position, characterized in that the paper stack is fed to the paper stack receiving position in an aligned and standing state where the spine of the paper stack is directed downward, wherein the paper stack supplying unit includes a nip head gripping the paper stack fed to the paper stack receiving position and supplying the paper stack between the pair of clamping plates stopping at the paper stack supply position, and a nip head drive mechanism moving the nip head between the paper stack receiving position and the paper stack supply position, the nip head having first and second nip plates extending parallel to the pair of clamping plates stopping at the paper stack supply position, and a nip plate drive mechanism moving each of the first and second nip plates in a longitudinal direction of the nip plate between a protruding position at which the nip plate protrudes from the nip head and a retracted position at which the nip plate retracts into the nip head, and translating the second nip plate in the protruding position relative to the first nip plate taking the protruding position between a first position at which the second nip plate receives the paper stack between the first and second nip plates and a second position at which the second nip plate cooperates with the first nip plate to grip the paper stack, wherein when the nip head supplies the paper stack between the pair of clamping plates, the paper stack gripped by the nip head is placed on the horizontal plate between the pair of clamping plates, and the nip head is located opposite the pair of clamping plates with respect to the positioning bar of the carriage clamp.

2. The bookbinding apparatus according to claim 1, wherein the nip plate drive mechanism of the nip head includes a first nip plate actuating unit fixed to the nip head so as to support the first nip plate and move the first nip plate in a longitudinal direction of the first nip plate between the protruding position and the retracted position, a second nip plate actuating unit supporting the second nip plate and moving the second nip plate in a longitudinal direction of the second nip plate between the protruding position and the retracted position, a first slide guide fixed to the nip head and extended at a right angle to the first and second nip plates between the first and second nip plate actuating units, the second nip plate actuating unit being slidably mounted on the first slide guide, the nip plate drive mechanism further including a drive mechanism attached to the nip head so as to slide the second nip plate actuating unit.

3. The bookbinding apparatus according to claim 1, wherein the paper stack fed to the paper stack receiving position is located right beside the pair of clamping plates of the at least one carriage clamp stopping at the paper stack supply position, wherein the nip head drive mechanism of the paper stack supplying unit includes a second slide guide extending in a direction perpendicular to the pair of clamping plates stopping at the paper stack supply position above the paper stack receiving position, a slider slidably mounted on the second slide guide, a slider drive mechanism sliding the slider, and an elevating mechanism attached to the slider so as to support the nip head in a manner such that the nip head can move up and down.

4. The bookbinding apparatus according to claim 1, further comprising an alignment bar arranged above or below the pair of clamping plates of the at least one carriage clamp stopping the paper stack supply position, extended parallel to the positioning bar of the at least one carriage clamp and across the pair of clamping plates, wherein, after the paper stack is supplied between the pair of clamping plates taking the open position, the alignment bar pushes an end face of the paper stack far from the positioning bar toward the positioning bar.

5. A bookbinding apparatus comprising:

a carriage clamp movable along a predetermined path while gripping a paper stack in a standing state; and a paper stack supplying unit for supplying the paper stack from a paper stack receiving position to the carriage clamp at a paper stack supply position, the carriage clamp including a pair of clamping plates movable between an open position at which the pair of clamping plates receives the paper stack and a closed position at which the pair of clamping plates grips the paper stack, and a positioning bar that contacts with the paper stack supplied between the pair of clamping plates, the positioning bar extending across the pair of clamping plates, the positioning bar being perpendicular to the predetermined path, wherein the paper stack supplying unit includes a nip head gripping the paper stack fed to the paper stack receiving position, and a nip head drive mechanism moving the nip head between the paper stack receiving position and the paper stack supply position, the nip head including a pair of nip plates having a longitudinal direction, the pair of the nip plates extending parallel to the pair of clamping plates, and a nip plate drive mechanism for moving the pair of nip plates along the longitudinal direction of the nip plate, and translating the pair of nip plates between a first position at which the paper stack is received between the pair of nip plates and a second position at which the paper stack is gripped by the pair of nip plates, the nip plate drive mechanism retracting at least one of the pair of nip plates in a direction in which the paper stack abuts the positioning bar after releasing the grip of the paper stack by the pair of nip plates at the paper stack supply position.

* * * * *